US006131966A

United States Patent [19]

Hensley et al.

[11] Patent Number: 6,131,966

[45] Date of Patent: Oct. 17, 2000

[54] LATCH HOLDBACK MECHANISM FOR A MORTISE LOCK

[75] Inventors: Frederick M. Hensley, Colorado Springs; Robert A. Babinski, Divide, both of Colo.

[73] Assignee: Schlage Lock Company, San Francisco, Calif.

[21] Appl. No.: 09/209,217

[22] Filed: Dec. 10, 1998

[51] Int. Cl.[7] ..... E05C 1/06

[52] U.S. Cl. ..... 292/139; 292/150; 292/DIG. 24; 70/107; 70/111; 70/150; 70/485; 70/DIG. 6

[58] Field of Search ..... 292/139, 150, 292/165, 167, 173, 143, DIG. 24, DIG. 27; 70/107, 108, 109, 110, 111, DIG. 6, 467, 468, 469, 470, 471, 483, 484, 485, 478, 479, 150

[56] References Cited

U.S. PATENT DOCUMENTS

| | | | |
|---|---|---|---|
| Re. 21,603 | 10/1940 | Brinton | 70/DIG. 6 |
| 903,839 | 11/1908 | Carroll | 70/150 |
| 1,138,580 | 5/1915 | Page | 70/150 |
| 1,168,725 | 1/1916 | Hurd . | |
| 1,241,787 | 10/1917 | Voight . | |
| 1,508,668 | 9/1924 | Prinzler . | |
| 1,701,099 | 2/1929 | Clark . | |
| 2,664,736 | 1/1954 | Chobert | 70/150 |
| 3,129,579 | 4/1964 | Bellantuono | 70/107 |
| 3,141,320 | 7/1964 | McConnell | 70/150 |
| 3,420,561 | 9/1966 | Russell et al. | 292/165 |
| 3,917,329 | 11/1975 | Fujiki et al. | 292/163 |
| 4,118,056 | 10/1978 | Alexander | 292/169.17 |
| 4,583,382 | 4/1986 | Hull | 70/107 |
| 4,950,005 | 8/1990 | Cudd | 292/150 |

*Primary Examiner*—B. Dayoan
*Assistant Examiner*—Clifford B Vaterlaus
*Attorney, Agent, or Firm*—Michael H. Minns

[57] ABSTRACT

A holdback dog for a mortise lock including a holdback dog slidably mounted to a tab on the mortise lock locking link. The holdback dog is activated by first retracting the latchbolt using the inside handle and then unlocking the lock using either the key cylinder or the inside thumbturn. When the lock is unlocked, the locking link moves downward, placing a tab on the holdback dog slide in confronting engagement with a corresponding tab on the bolt slide. After the inside handle is released, the holdback dog tab holds the bolt slide, and therefor the latchbolt, in the retracted or "dogged" position. For normal or "undogged" operation, the slidable mounting of the holdback slide allows the bolt slide tab to engage the holdback dog tab and push the holdback dog slide out of the way, when the lock is unlocked and either handle is operated, thereby permitting normal operation.

7 Claims, 9 Drawing Sheets

LATCH HOLDBACK MECHANISM FOR A MORTISE LOCK

BACKGROUND OF THE INVENTION

This invention relates generally to mortise locks and more particularly to latch holdback mechanism for a mortise lock.

In mortise locks, it is frequently desirable to set the latchbolt in a retracted position, making it unnecessary to use the knob or lever to open the door. There have been locks which have a latchbolt holdback device, but they generally have been somewhat complicated, requiring a relatively large number of extra parts over and above those used in the basic mortise lock. In other designs, mortise locks have used some extra device on the exterior of the lock case which needs to be operated to set the latchbolt in the retracted position.

The foregoing illustrates limitations known to exist in present latchbolt holdback mechanisms for mortise locks. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a dogging mechanism for a mortise lock, the mortise lock having at least two operative modes, a normal mode and a dogged mode, the mortise lock including a moveable locking link, a latchbolt moveable between an extended position and a retracted position, the latchbolt including a latchbolt bar having a bolt slide thereon, the dogging mechanism comprising: a holdback dog including a slide means for permitting the holdback dog to slide, the holdback dog being moveable between an upper position distal the bolt slide and a lower position where the holdback dog is in contacting engagement with the bolt slide when the latchbolt is in the retracted position, whereby when the mortise lock is in: a) the dogged mode, the holdback dog engages a first side of the bolt slide, thereby retaining the latchbolt in the retracted position, and b) the normal mode, the holdback dog engages a second side of the bolt slide, the slide means permitting the holdback dog to move with the latchbolt when the latchbolt is moved between the extended positions and the retracted positions.

The foregoing and other aspects will become apparent from the following detailed description of the invention when considered in conjunction with the accompanying drawing figures.

BRIEF DESCRIPTION OF THE DRAWING FIGURES

Figure 1:
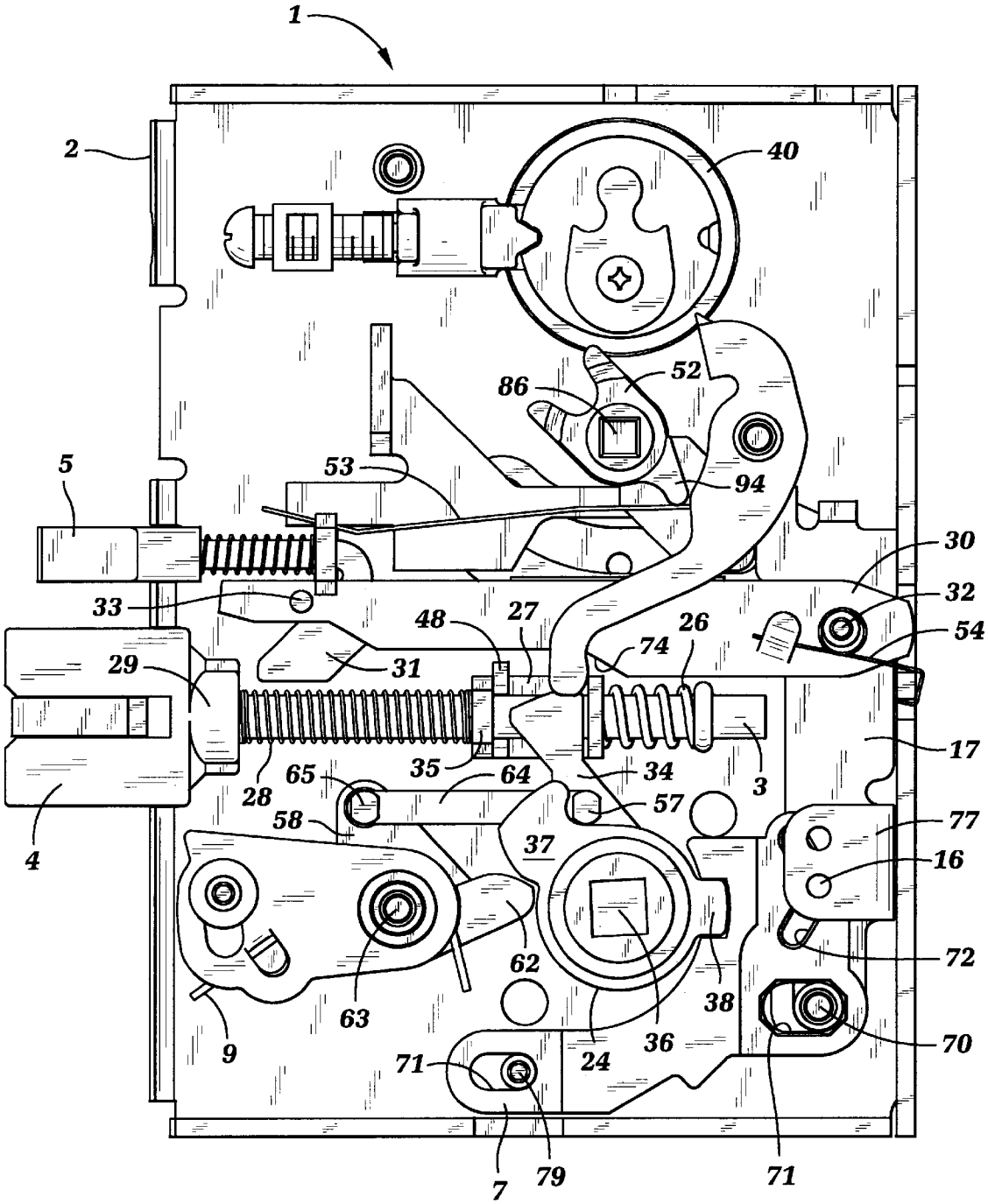
FIG. 1 is a plan view of a mortise including the holdback mechanism of the present invention.
Figure 8:
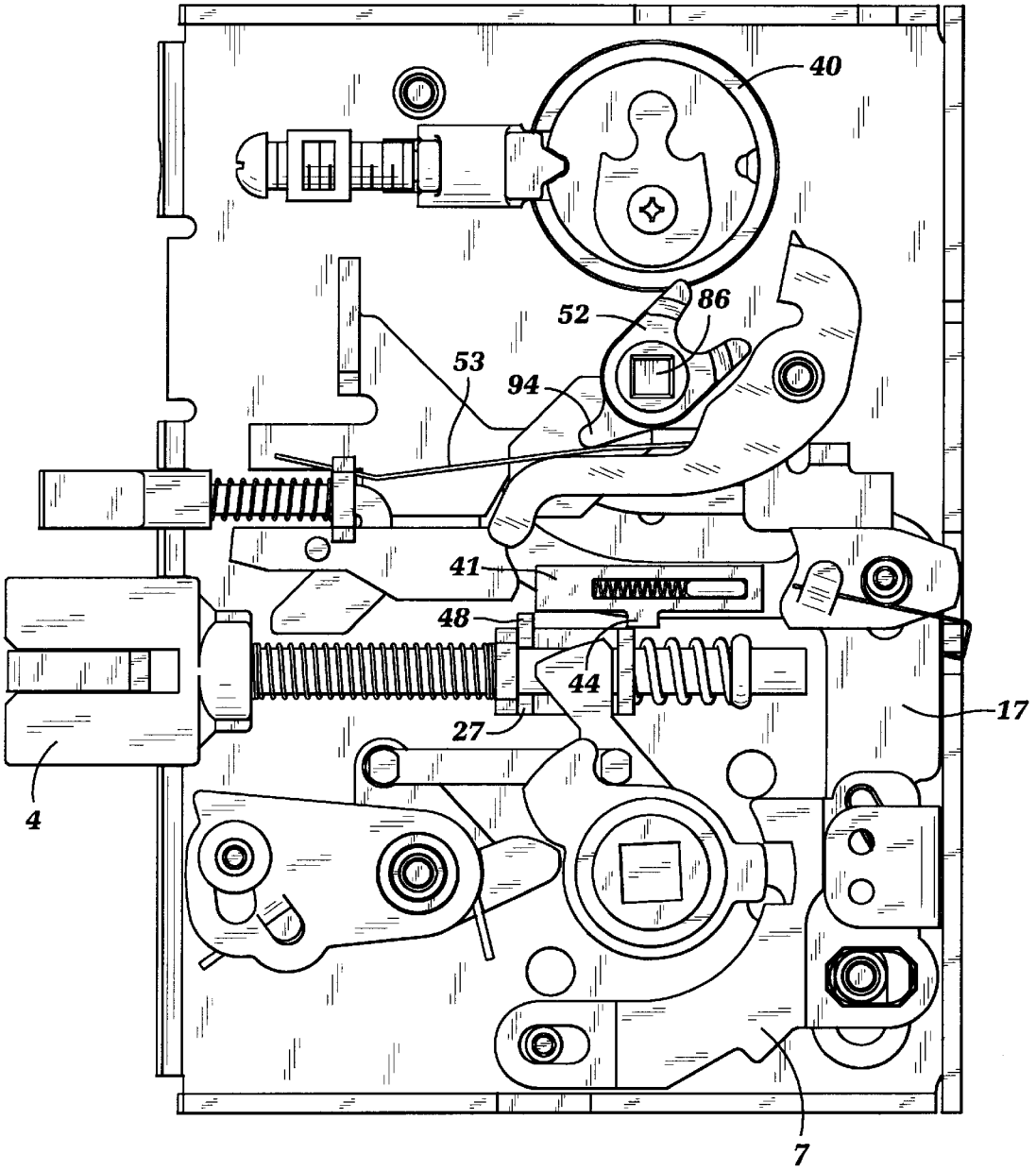
Figure 9:
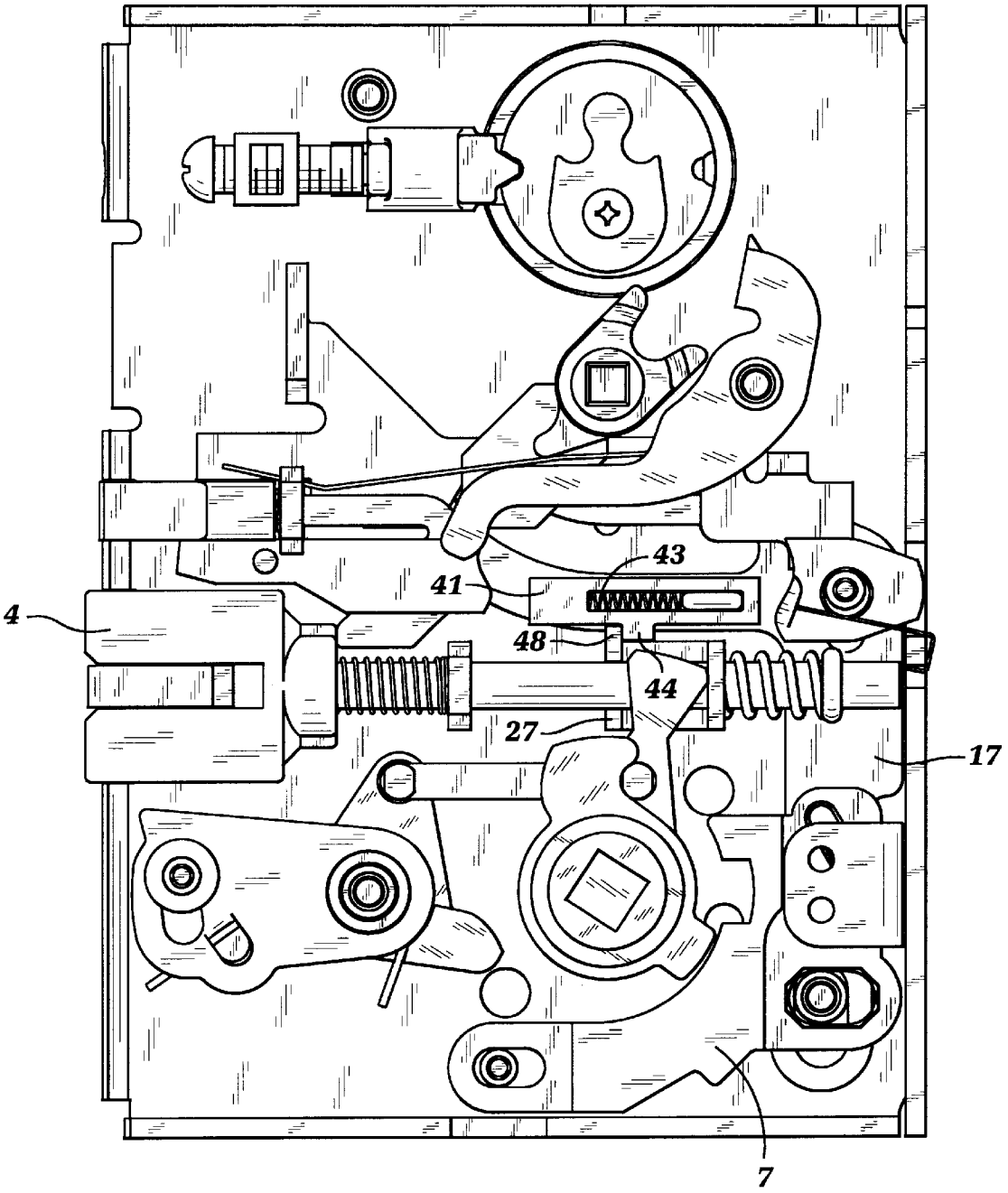

FIG. 8 is a plan view of the mortise lock shown in FIG. 1 showing the mortise lock in the unlocked position, portions of several lock components have been removed to more clearly illustrate the holdback mechanism; and FIG. 9 is a plan view of the mortise lock shown in FIG. 1 showing the mortise lock in the unlocked position with the latchbolt retracted, portions of several lock components have been removed to more clearly illustrate the holdback mechanism;

DETAILED DESCRIPTION

FIG. 1 shows a typical mortise lock, similar to the mortise lock described in U.S. Pat. No. 4,583,382, which is hereby incorporated by reference. Shown in FIG. 1 are the retractor hubs 24, which are operated by the lock handles (not shown) and permit under certain conditions the retraction of the latchbolt 4. The lock 1 is provided with a locking catch 7, which selectively secures one retractor hub 24 section from rotation. A retractor lever 34 operates in response to rotation of the retractor hub 24. The retractor lever 34 contacts bolt slide 27 of the latchbolt 4 and provides the direct contact means for retracting the latchbolt. Bolt slide 27 is slidably mounted on the latchbolt bar 3 and resiliently positioned by release spring 26. Latchbolt spring 28 serves to extend latchbolt 4 by interaction between the latchbolt hub 29 and latchbolt guide 35.

Retractor hub 24 is rotatably mounted in the lock case 2 and is operated by means of the lock handles through spindle mounting hole 36. Retractor hub 24 is comprised of two identical overlaid sections each having an operating tooth 37 and a locking link engaging projection 38. The mounting of the two identical hub sections permits either section to rotate clockwise or counterclockwise independent of each other. One section lies to the inside of the lock case 2. The other lies to the outside of the lock case. In the FIGURES, only the retractor hub section towards the viewer may be seen. It should be appreciated that rotation of one of the retractor hubs will not rotate the other hub. However, since both hubs provide the same function, it should be understood that rotation of the inside hub section may operate the latchbolt 4 while the outside hub section is locked from outside rotation by the locking catch 7.

Referring now to FIG. 1, clockwise rotation of the retractor hub 24 will cause operating tooth 37 to engage the retractor lever 34 via engaging projection 57 on retractor link 64. This will in turn cause the retractor lever 34 to rotate about the center of the retractor hub 24 and thereby, through contact with the bolt slide 27, cause the latchbolt 4 to be displaced to the right.

Counterclockwise rotation of the retractor hub 24 causes the operating tooth 37 to contact retractor crank 58 at its full depth tooth-like projection 62. This contact rotates retractor crank 58 about retractor crank post 63 in a clockwise direction thereby displacing retractor link 64 to the right. Retractor link 64 is pivotally connected to the retractor crank 58 at engaging projection 65 on its one end and retractor lever 34 on its other end. Hub spring 9 resists the clockwise rotation of the retractor crank 58 and restores the retractor hubs 24 to the neutral position when the lock handles are released.

FIG. 1 shows the locking catch 7 engaged with the retractor hub 24, thereby preventing it from rotating. This position locks the outside handle and prevents retraction of the latchbolt 4 from the outside of the lock 1. FIG. 8 shows the locking catch 7 disengaged from the retractor hub 24, thereby allowing the retractor hub 24 to rotate.

The locking catch 7 is slidably mounted on posts 70 and 79 which cooperate with the elongated holes 71 in the locking catch 7 to permit horizontal displacement of the locking catch 7 between the locked and the unlocked positions. Locking catch V-shaped cam slot 72 provides the drive to displace the locking catch 7 between the locked and the unlocked positions. The locking link function is accomplished by action on the locking link 17. Locking link 17 is mounted for linear translation in the vertical direction as shown in the FIGURES. Auxiliary bar post 32 near the top of the locking link 17 and guide post 70 located near the bottom of the locking link 17 cooperate with elongated slots 75 (shown in FIG. 2) in the locking link 17 to permit the translation movement. The locking link 17 is provided with a folded-over bracket 77 which supports locking link cam pin 16. The locking link cam pin 16 cooperates with the locking catch V-shaped cam slot 72 in locking catch 7 in such a manner that displacement of the locking link 17 vertically upward cams the locking catch 7 to the left or locked position as shown in FIG. 1.

To lock the mortise lock 1, either a key cylinder 40, or a thumbturn (not shown) which engages a square bore 86 in turn hub 52, is operated to turn the turn hub 52 from a locked position, shown in FIG. 1, to an unlocked position, shown in FIG. 8. Turn hub spring 53 biases the turn hub 52 by interaction with depending lobe 94 on turn hub 52 in either the locked position or the unlocked position. When turn hub 52 is moved from the locked position to the unlocked position, a pin (not shown) extending from the rear side of turn hub projection 95, shown in FIG. 5, interacts with arcuate camming slot 76 in locking link 17 (shown in FIG. 2). This camming action moves locking link 17 from an upper locked position, shown in FIG. 1, to a lower unlocked position, shown in FIG. 5.

Figure 4:
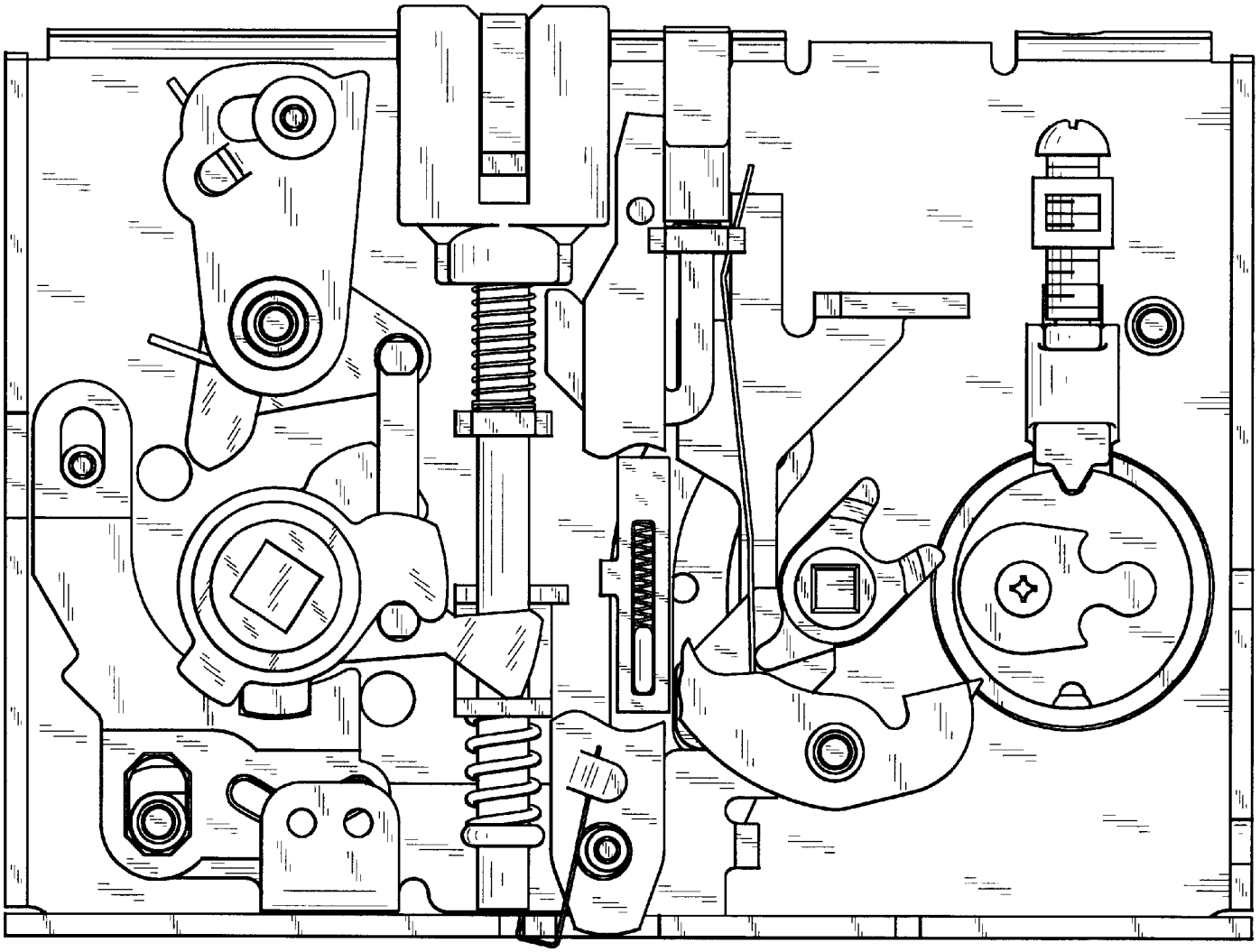
FIG. 4 is a plan view of the mortise lock shown in FIG. 1 showing the mortise lock in the locked position with the latchbolt retracted by the inside handle, portions of several lock components have been removed to more clearly illustrate the holdback mechanism.

When the mortise lock 1 is locked, as shown in FIG. 1, and the door is closed, an auxiliary latchbolt 5 will be depressed into a retracted position, similar to that shown in FIG. 4, by contact with the door frame. The auxiliary latchbolt 5 interacts with a auxiliary stop 30 which is pivotably mounted on auxiliary bar post 32 and is biased by spring stop 54 such that the free end of auxiliary stop 30, near the latchbolt hub 29, pivots down to confront the latchbolt hub 29, when the auxiliary latchbolt 5 is depressed into a retracted position while the latchbolt 4 is in an extended position. The purpose of auxiliary latchbolt 5 and auxiliary stop 30 is to prevent the latchbolt 4 from being depressed, thereby unlocking the door, by techniques, such as "carding". Attached to an end of auxiliary latchbolt 5 is an auxiliary bar 31 which functions as a cam in conjunction with a latchbolt stop pin 33 attached near the free end of auxiliary stop 30. When the door is closed, the action of the door frame on auxiliary latchbolt 5 moves it from the extended position to the retracted position and the auxiliary bar 31 acts on latchbolt stop pin 33 to cam the latchbolt stop out of its confronting position with the latchbolt hub 29, allowing the latchbolt 4 to be pushed by the door frame into its retracted position. When a locked lock 1 is opened from the inside, the side towards the viewer in the FIGURES, as the bolt slide 27 moves to the right, the bolt slide 27 contacts a cam stop 74 on auxiliary stop 30, shown in FIG. 1, and cams the auxiliary stop 30 upward out of its confronting position, thereby permitting further movement of the bolt slide 27 to retract the latchbolt 4.

Figure 2:
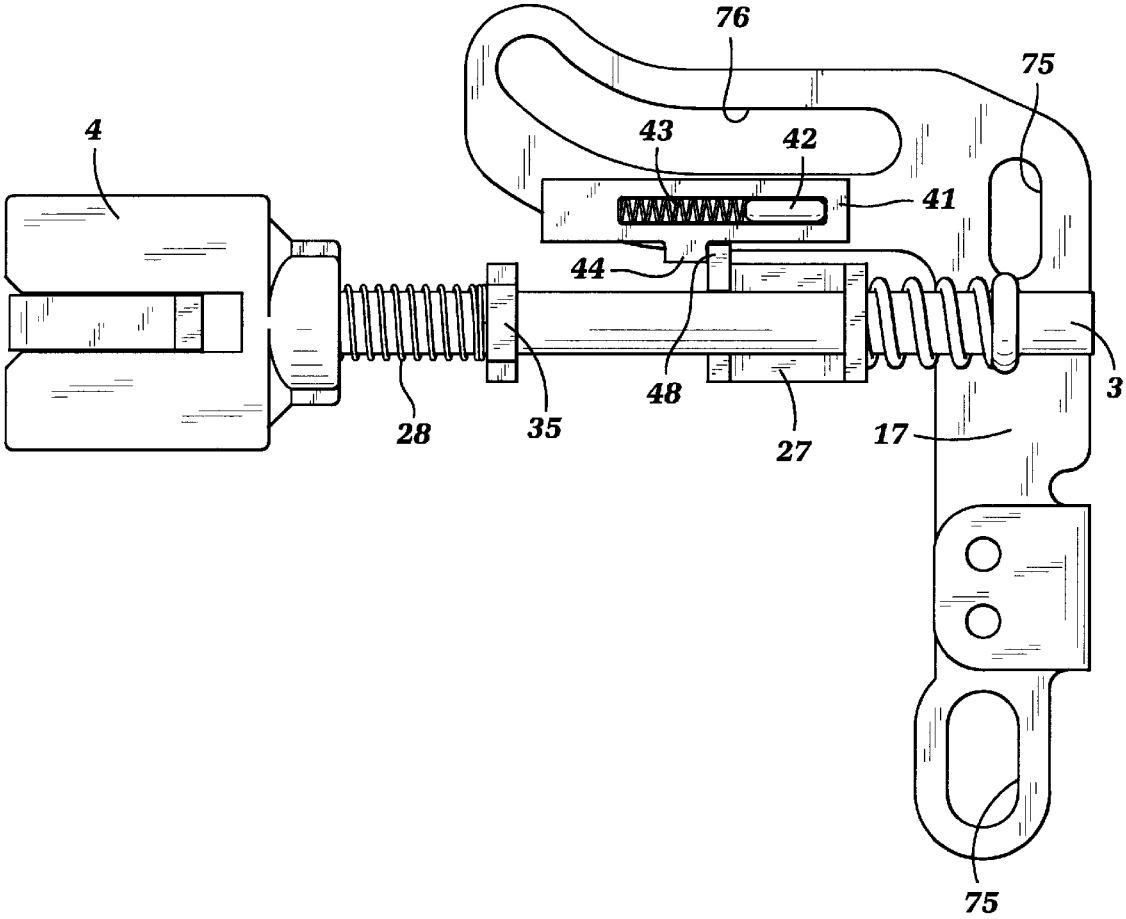
FIG. 2 is a plan view of the latchbolt and locking link of the mortise lock shown in FIG. 1, illustrating the holdback mechanism.

FIG. 2 illustrates the main components of the holdback mechanism or holdback dog of the present invention, shown in the "dogged" condition. The locking link 17 has a slide key 42 extending therefrom. A holdback dog slide 41 slidably engages the slide key 42. Holdback dog spring 43 biases the holdback dog slide 41 to a leftward or pre-engagement position. A tab 44 extends from the holdback dog slide 41 to be in contacting engagement with a corresponding tab 48 extending from the left most end of bolt slide 27.

Figure 3:
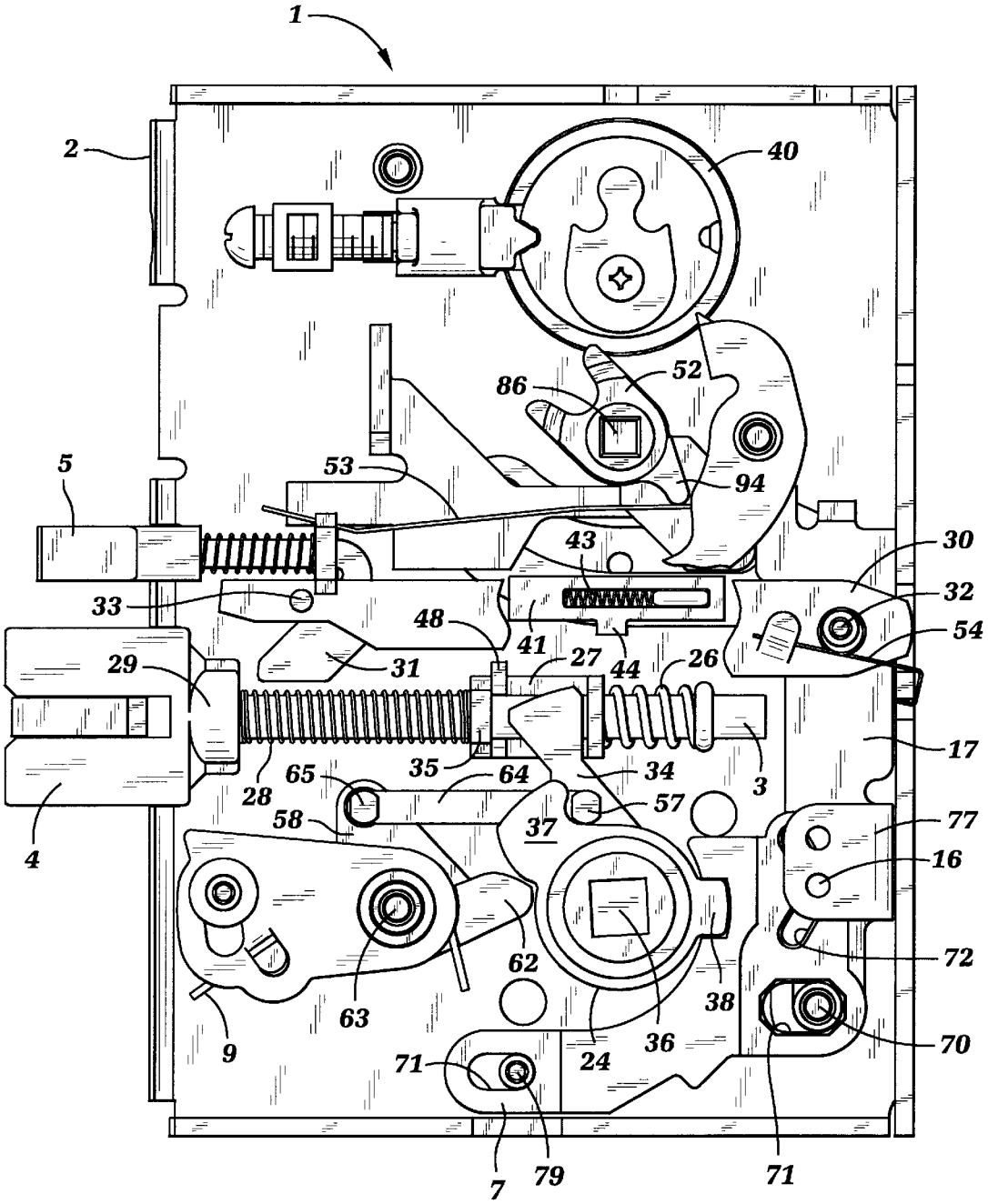
FIG. 3 is a plan view of the mortise lock shown in FIG. 1 showing the mortise lock in the locked position, portions of several lock components have been removed to more clearly illustrate the holdback mechanism.
Figure 5:
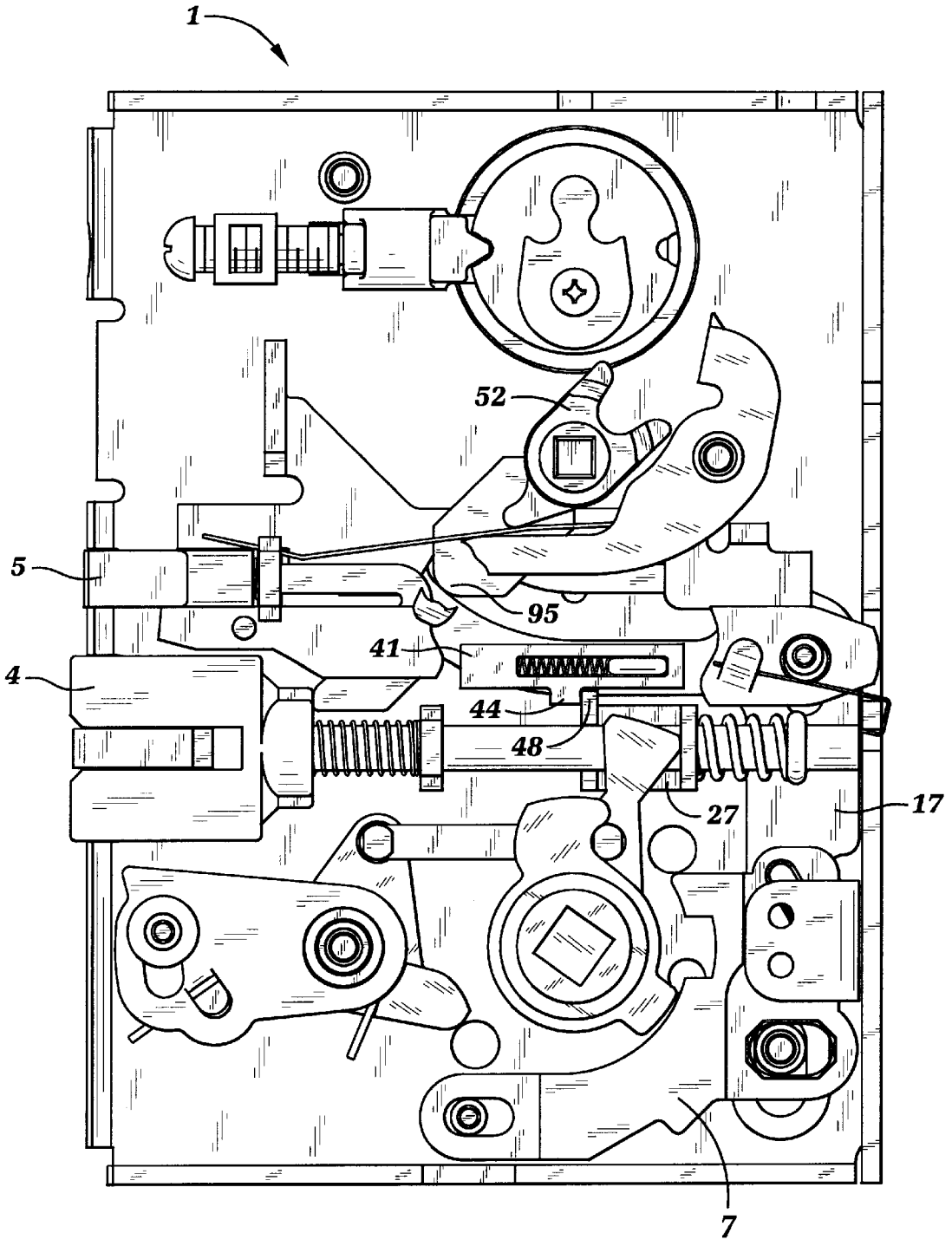
FIG. 5 is a plan view of the mortise lock shown in FIG. 1 showing the mortise lock with the latchbolt retracted by the inside handle, the cylinder unlocked with the holdback dog in position to activate, portions of several lock components have been removed to more clearly illustrate the holdback mechanism.
Figure 6:
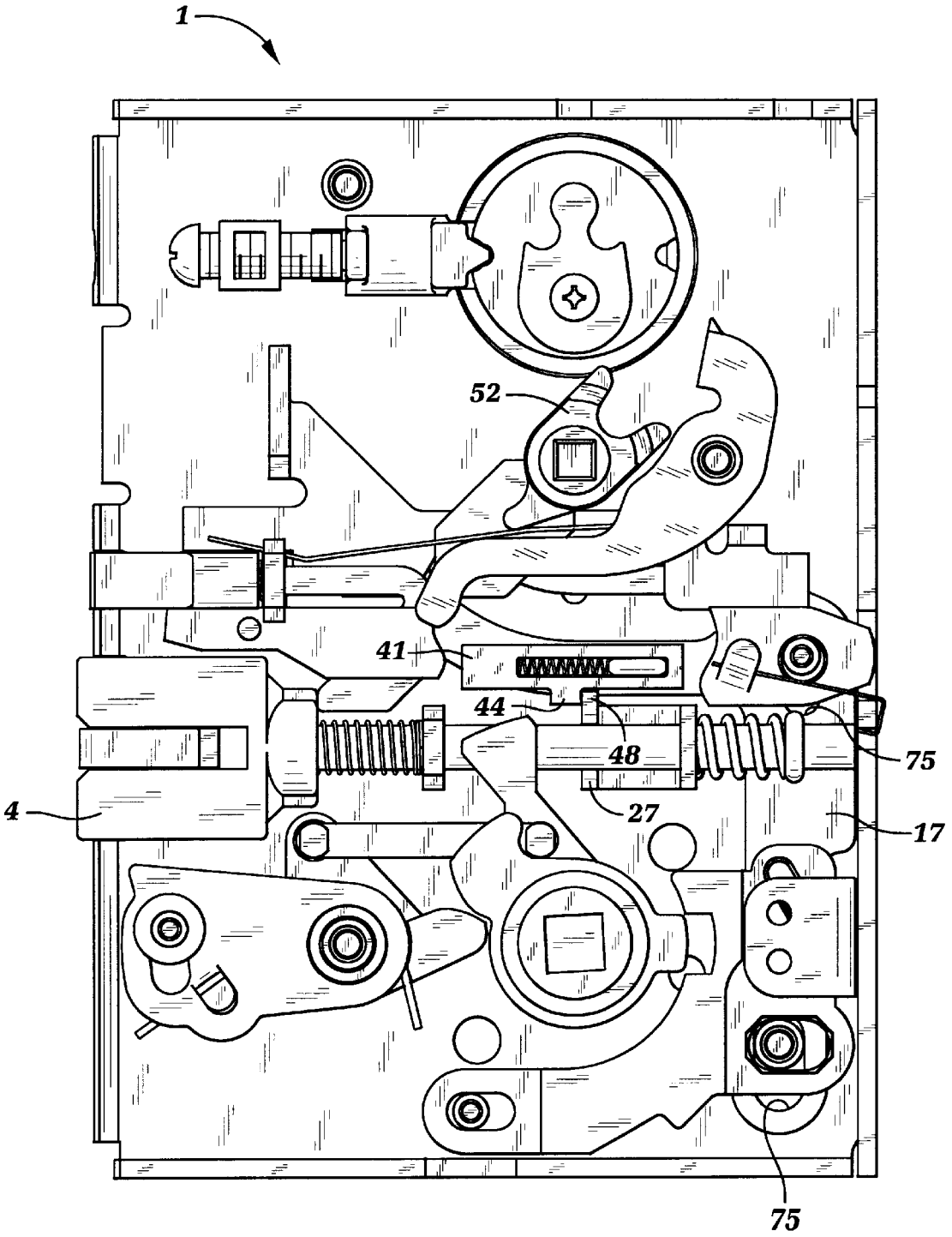
FIG. 6 is a plan view of the mortise lock shown in FIG. 1 showing the mortise lock in the unlocked position with the holdback dog activated, portions of several lock components have been removed to more clearly illustrate the holdback mechanism.
Figure 7:
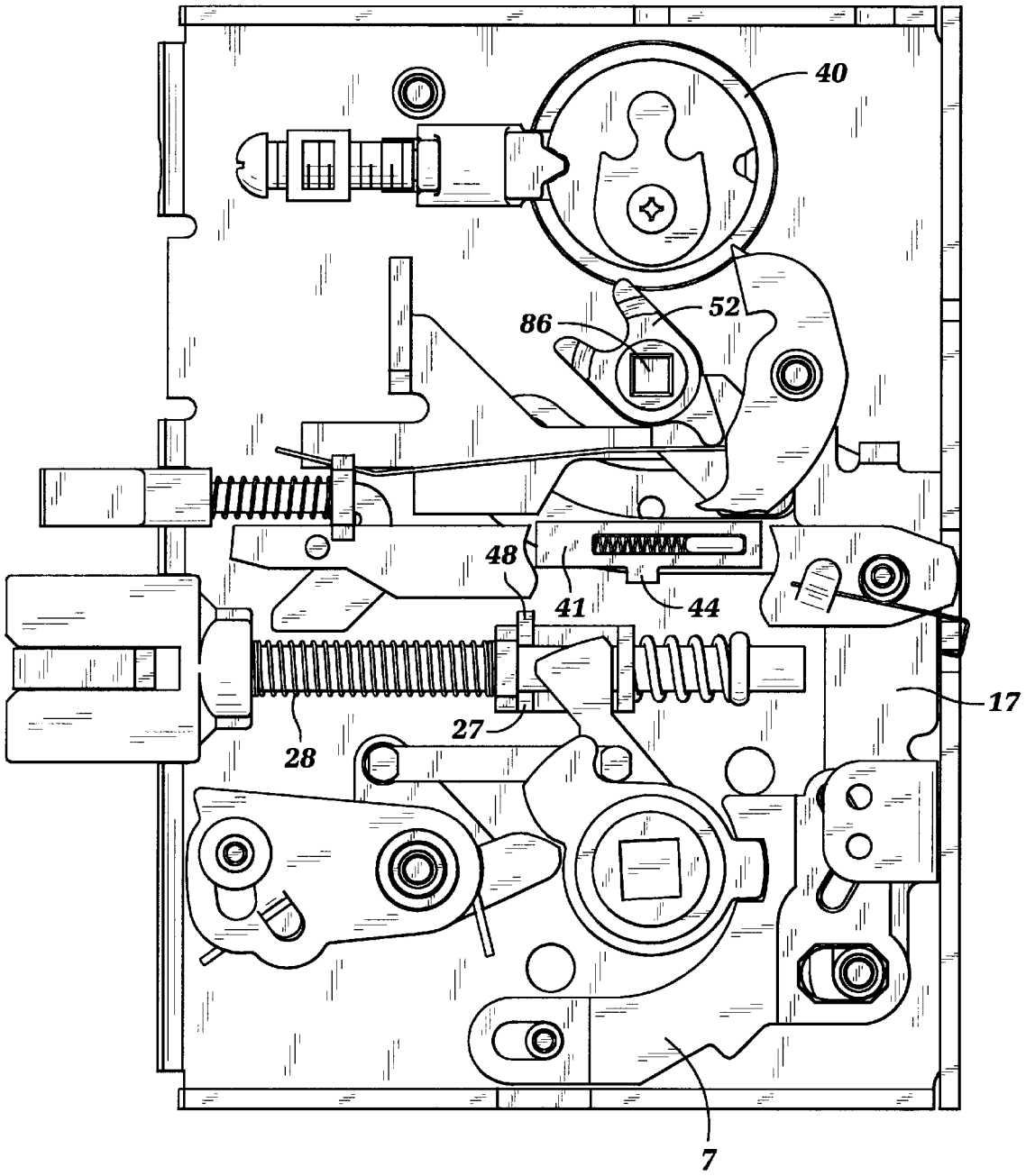
FIG. 7 is a plan view of the mortise lock shown in FIG. 1 showing the mortise lock in re-locked position with the holdback dog de-activated, portions of several lock components have been removed to more clearly illustrate the holdback mechanism.

Starting with the lock 1 in the locked position, shown in FIG. 3, the locking catch 7 is engaging the outer hub projection 38, thereby locking the lock 1 from operation by the outside handle. The locking link 17 is in its upper position and the holdback dog slide 41 is distal the bolt slide 27. FIG. 4 shows the lock 1 still in the locked position, the locking catch 7 is engaging the outer hub projection 38, still locking the lock from operation by the outside handle. The latchbolt 4 has been retracted by operation of the inside handle. With the latchbolt 4 still being retracted by the inside handle, the thumbturn is turned to move the turn hub 52 from the locked position to the unlocked position. The movement of turn hub 52 moves the locking link 17 to its lower position, which also moves the holdback dog slide 41 to its lower position with the holdback dog tab 44 contacting and engaging the left side of bolt slide tab 48, as shown in FIGS. 2 and 5. When the inside handle is released, as shown in FIG. 6, the holdback mechanism is activated with the contacting engagement of the holdback dog tab 44 and the bolt slide tab 48 holding the latchbolt 4 in its retracted position. FIG. 7 shows the lock 1 after either the thumbturn or the key cylinder 40 has been operated to return the lock to the locked condition. The movement of turn hub 52 moves the locking link 17 to its upper position, moving the holdback dog slide 41 and tab 44 away from confronting engagement with bolt slide tab 48, thereby releasing the holdback mechanism allowing latchbolt spring 28 to return the latchbolt 4 to the extended position.

FIGS. 8 and 9 show a desirable feature of the holdback mechanism. When the lock is unlocked, as shown in FIG. 8, and either the inside handle or the outside handle is operated to retract the latchbolt 4, (the locking link 17 and the attached holdback dog slide 41 being in the lower or unlocked position), the slidable mounting of the holdback dog slide 41 allows the holdback dog slide 41 to move to the right, out of the way, when the latchbolt 4 is retracted. The bolt slide tab 48 contacts the holdback dog tab 44 and pushes the holdback dog slide 41 to the right as the latchbolt 4 is retracted, as shown in FIG. 9. The holdback dog spring 43 returns the holdback dog slide 41 to its normal leftmost position, as shown in FIG. 3, when the handle is released.

Having described the invention, what is claimed is:

1. A dogging mechanism for a mortise lock, the mortise lock having at least two operative modes, a normal mode and a dogged mode, the mortise lock including a moveable locking link, a latchbolt moveable between an extended position and a retracted position, the latchbolt including a latchbolt bar having a bolt slide thereon, the dogging mechanism comprising:

a holdback dog including a slide means, mounted on the moveable locking link, for permitting the holdback dog to slide relative to the moveable locking link, the holdback dog being moveable between an upper position distal the bolt slide and a lower position where the holdback dog is in contacting engagement with the bolt slide when the latchbolt is in the retracted position, whereby when the mortise lock is in:

a) the dogged mode, the holdback dog engages a first side of the bolt slide, thereby retaining the latchbolt in the retracted position, and b) the normal mode, the holdback dog engages a second side of the bolt slide, the slide means permitting the holdback dog to move with the latchbolt when the latchbolt is moved between the extended positions and the retracted positions.

2. The dogging mechanism according to claim 1, further comprising the locking link having a tab extending therefrom, the holdback dog slidably engaging the locking link tab.

3. The dogging mechanism according to claim 2, wherein the holdback dog has a slot therein, the locking link tab engaging the slot.

4. The dogging mechanism according to claim 3, wherein the holdback dog is slidable along a line parallel to the direction in which the latchbolt moves when moving between the extended position and the retracted position, and further comprising a spring within the slot for biasing the holdback dog in the same direction the latchbolt moves when the latchbolt is moved from the retracted position to the extended position.

5. The dogging mechanism according to claim 1, wherein the holdback dog is slidable along a line parallel to the direction in which the latchbolt moves when moving between the extended position and the retracted position.

6. The dogging mechanism according to claim 1, further comprising: a tab extending from the bolt slide; and a tab extending from the holdback dog, whereby when the holdback dog is in the lower position, the holdback dog tab is in contacting engagement with the bolt slide tab.

7. A dogging mechanism for a mortise lock, the mortise lock including a moveable locking link, a latchbolt moveable between an extended position and a retracted position, the latchbolt including a latchbolt bar having a bolt slide thereon, the dogging mechanism comprising:

a holdback dog including a slide means, mounted on the moveable locking link, for permitting the holdback dog to slide relative to the moveable locking link, the holdback dog being moveable between an upper position distal the bolt slide and a lower position where the holdback dog is in contacting engagement with the bolt slide when the latchbolt is in the retracted position, whereby when the latchbolt is in the retracted position prior to the holdback dog being moved to the lower position, and the holdback dog is then moved to the lower position, the holdback dog engages a first side of the bolt slide, thereby retaining the latchbolt in the retracted position, and when the holdback dog is moved to the lower position while the latchbolt is in the extended position and the latchbolt is then moved to the retracted position, the holdback dog engages a second side of the bolt slide, the slide means permitting the holdback dog to move with the latchbolt while the latchbolt is moved between the extended positions and the retracted positions.

* * * * *